US005842424A

United States Patent [19]

Prévot et al.

[11] Patent Number: 5,842,424

[45] Date of Patent: Dec. 1, 1998

[54] TRANSPORT PALLET AND METHOD FOR DEPALLETIZING A LOAD

[75] Inventors: Jean-Paul Prévot, Fontenay le Fleury; Pascal Ricou, Le Plesses Grammoire, both of France

[73] Assignee: Bull S.A., Louveciennes, France

[21] Appl. No.: 761,114

[22] Filed: Dec. 6, 1996

[30] Foreign Application Priority Data

Dec. 8, 1995 [FR] France ..... 95 14577

[51] Int. Cl.[6] ..... B65D 19/30

[52] U.S. Cl. ..... 108/54.1; 108/55.3

[58] Field of Search ..... 108/51.11, 54.1, 108/55.3, 57.12, 56.3, 55.1

[56] References Cited

U.S. PATENT DOCUMENTS

| | | | |
|---|---|---|---|
| 2,529,752 | 11/1950 | Whittle | 108/55.1 X |
| 2,643,081 | 6/1953 | Spring | 108/54.1 |
| 2,936,985 | 5/1960 | Doerr et al. | 108/54.1 X |
| 3,267,882 | 8/1966 | Rapson et al. | 108/51.11 |
| 3,275,131 | 9/1966 | Erickson | 108/57.12 X |
| 3,523,507 | 8/1970 | Dubin . | |
| 3,790,110 | 2/1974 | Stirling et al. | 108/51.11 X |
| 4,911,084 | 3/1990 | Sato . | |
| 4,911,318 | 3/1990 | Bishop | 108/51.11 X |
| 5,052,307 | 10/1991 | Morrison | 108/55.3 X |
| 5,170,721 | 12/1992 | Troth . | |
| 5,257,896 | 11/1993 | Hastings | 108/55.1 X |
| 5,505,140 | 4/1996 | Wittman | 108/55.1 X |
| 5,544,999 | 8/1996 | Ducharme et al. | 108/55.1 X |
| 5,644,991 | 7/1997 | Prévot et al. | 108/54.1 |

FOREIGN PATENT DOCUMENTS

| | | |
|---|---|---|
| 938419 | 1/1956 | Germany . |
| 9409613 | 5/1994 | WIPO . |

*Primary Examiner*—Jose V. Chen

*Attorney, Agent, or Firm*—Kerkam, Stowell, Kondracki & Clarke, P.C.; Edward J. Kondracki

[57] ABSTRACT

A pallet (10) for transporting a load (19) includes a deck (11) provided with two skids (12). Depalletization is effected by inclining the deck caused by pivoting the skids so as to space them apart from lateral edges of the deck.

16 Claims, 4 Drawing Sheets

TRANSPORT PALLET AND METHOD FOR DEPALLETIZING A LOAD

BACKGROUND OF THE INVENTION

1. Field of the Invention

The invention relates to transport pallets, more particularly those adapted for transporting heavy, bulky and fragile objects, such as cabinets for processing electrical signals by means of integrated circuits. The invention applies more particularly to pallets for transporting cabinets for information processing machines. Transporting ordinarily includes the operations of handling, transporting per se, and storage. The subjects of the invention are a method for depalletization and a resultant pallet.

2. Description of the Related Art

An ordinary pallet is made of a loading platform or load board that includes two decks connected to one another by braces or deck spacers that allow the passage of the forks of fork lifts and pallet stackers. The invention relates to non-reversible pallets with a small support or load bearing surface, intended for the specific usages referred to above. Under these conditions, the lower deck forms a sole plate and along with the braces or deck spacers constitutes the means for supporting the upper deck. Thus the deck and its means of support form a fixed, nonmovable structure, that is quite capable of supporting the weight of the cabinet. When the load has to be immobilized on the pallet, the pallet is provided with load retaining means that form a raising block or collar for the pallet. These load retaining means are quite varied, and they may be highly sophisticated for specific uses.

Typical example of known arrangements include U.S. Pat. Nos. 3,949,878 and 3,779,571; Belgium Patent No. 547,276 and German Patent No. 3,312,477 and application Ser. No. 08/499,374 in the name of the inventors herein and assigned to the assignee of the present invention.

Computer cabinets demand very stringent handling conditions, which greatly highlight the problems that the invention solves. First, these cabinets are very expensive. They contain miniaturized electrical and electronic elements to suit them for the large scale of integration of circuits in a semiconductor material, and to offer the shortest possible paths for very high frequency electrical signals. These components and their assembly are accordingly fragile and cannot withstand major impacts or shock. They are also quite sensitive to environmental conditions, especially thermal, mechanical and electromagnetic conditions. For example, they must be protected from dust, and kept in a dry atmosphere and at a temperature that is not excessive. Accordingly, the cabinets are packaged in a sealed or impermeable sheath of strong plastic, which must be well protected to prevent it from being opened during transport, for example in response to a lateral impact. In addition, these cabinets are very heavy, weighing on the order of 250 kg for average systems to more than 500 kg for very large multi-processor information processing systems. The removal from the pallet (depalletization) of the cabinet at its destination accordingly presents many problems. The cabinet is released from the means for retaining it on the pallet. This requires the intervention of several people with good control of the displacements of the cabinet on the very limited surface area of the deck of the pallet, and requires the avoidance of any impact or overturning as the cabinet is lowered. Ordinarily, rails are shipped with the cabinet to be used for lowering the cabinet. However, taking into account the weight of the cabinet and the relatively great height of the deck, the rails must be very resistant to flexion and must be long enough to prevent a slope that is not overly pronounced, in order to limit the longitudinal thrust of the cabinet. Hence the rails are made of thick steel and comprise very heavy, bulky elements that have to accompany the cabinets. The problems presented by transporting these cabinets are accordingly numerous and very constraining. In addition, although they are fragile, their weight and volume require that they be transported with large vehicles, and by persons whose job is to handle large or heavy equipment, such as machine tools and agricultural machines, which are much sturdier, are generally less careful about taking the kind precautions that this type of cabinet normally requires.

SUMMARY OF THE INVENTION

One of the objects of the invention is to facilitate the depalletization of a cabinet. Another object is to protect the cabinet against the possible impacts involved in transport. Still another object is to meet both of the above two objects with simple, not very bulky means that are easy to use and not very expensive.

The subject of the invention is a method for depalletizing a load mounted on a pallet made on a deck resting on skids, characterized in that it consists of inclining the deck.

Preferably, the method comprises causing the skids to pivot parallel to the deck in order to incline the deck and displace the load along the angle of inclination of the deck.

The subject of the invention is also a pallet for transporting a load, comprising a deck and means for supporting the deck that include two skids, characterized in that the two skids are mounted in such a way as to be capable of pivoting into the plane of the deck.

BRIEF DESCRIPTION OF THE DRAWINGS

The exemplary pallet to be described below with reference to the accompanying drawings will make the characteristics and advantages of the invention apparently. In the drawings.

DESCRIPTION OF THE PREFERRED EMBODIMENTS

Figure 1:
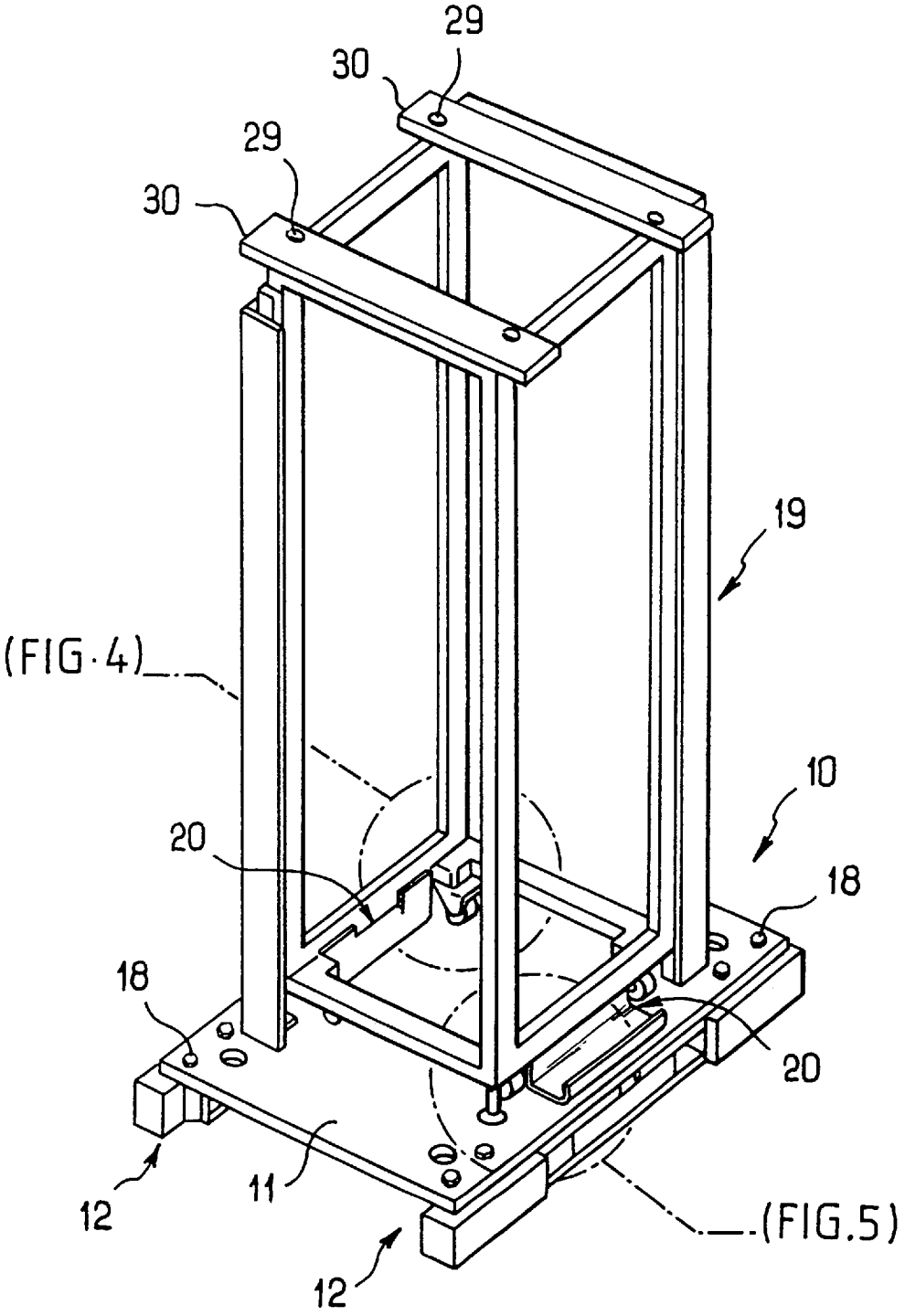
FIG. 1 is a perspective view of a pallet according to the invention for transporting a computer cabinet, represented schematically by a frame.
Figure 2:
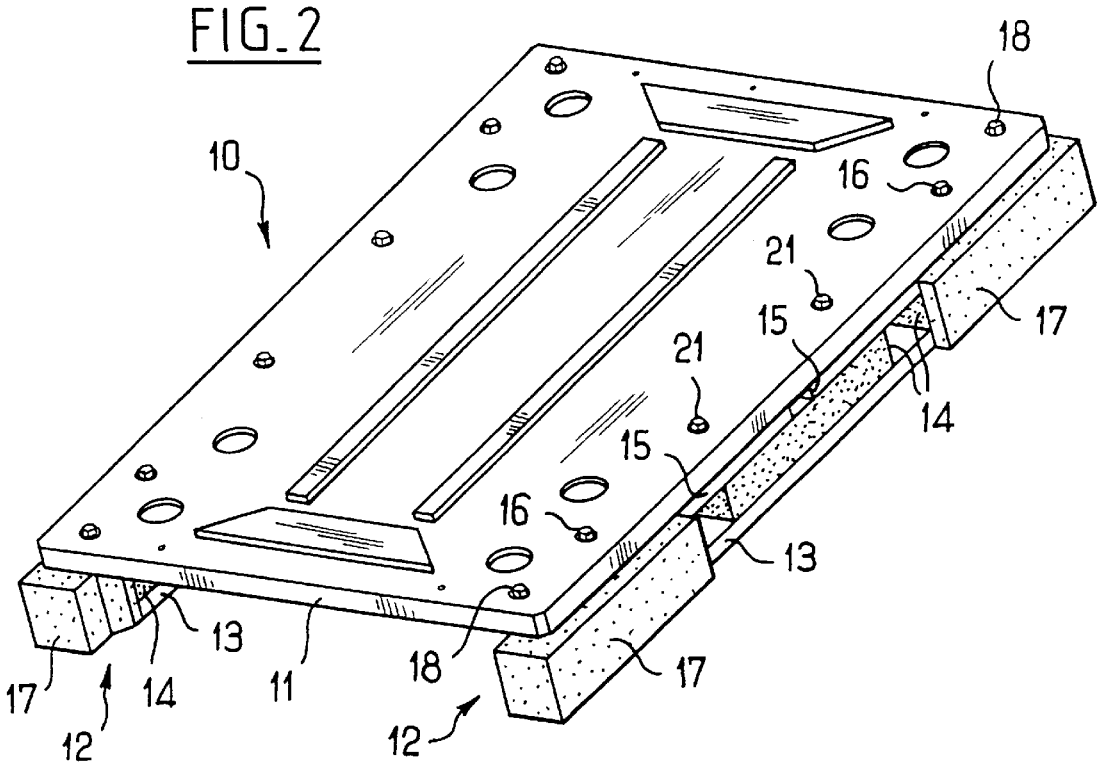
FIG. 2 is a perspective view on a larger scale of the pallet of FIG. 1.
Figure 3:
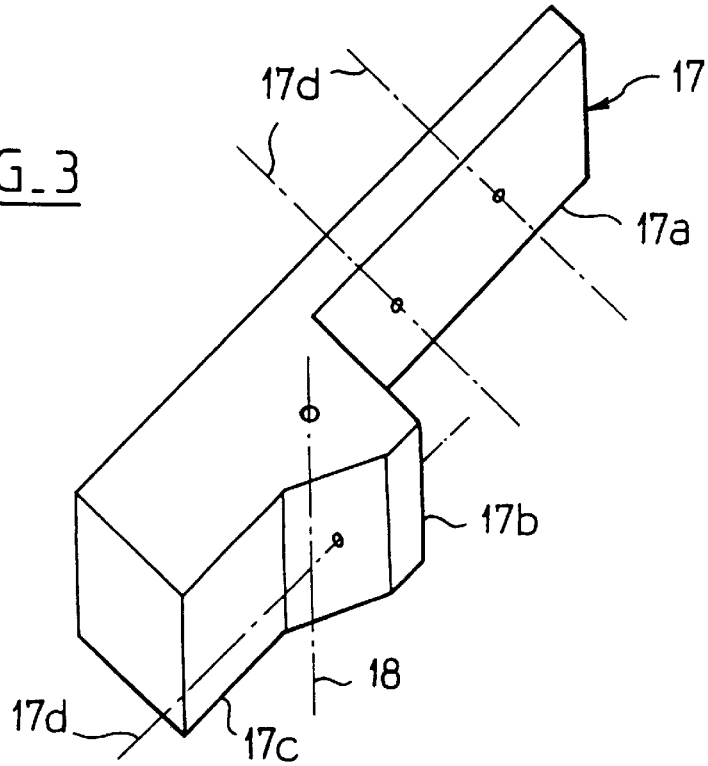
FIG. 3 is a perspective view of an anti-impact fitting for the pallet represented in FIGS. 1 and 2.
Figure 10:
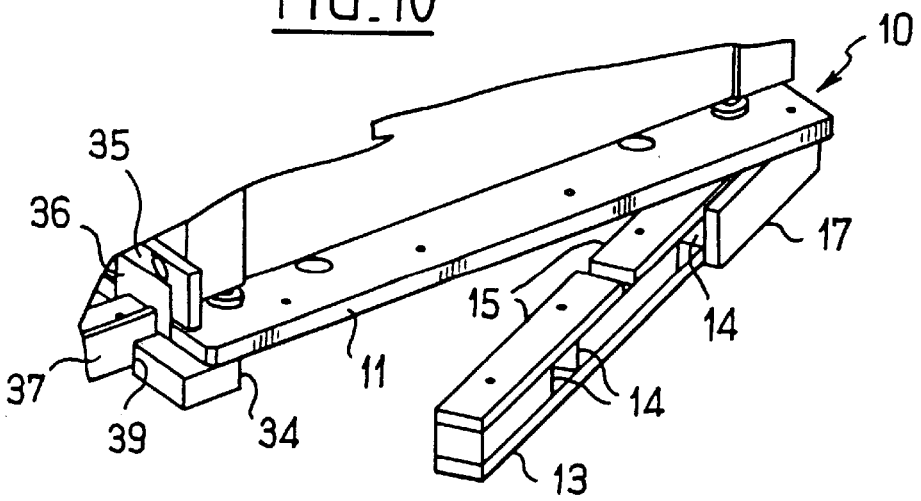
FIG. 10 is a perspective view on a larger scale on a portion of the pallet shown in the circle outlined in FIG. 9.

The pallet 10 shown in FIG. 1 essentially includes a rectangular deck 11, provided with support means formed by two lateral skids 12 mounted under the deck, approximately along the length of two of its opposed edges. The other two opposed edges define the front and back of the deck. The spacing and height of the skids 12 are adapted to the passage of forks of fork lifts and pallet stackers. In the example made, the height of the skids under the deck was on the order of 100 mm. With reference to FIGS. 2, 3 and 10, each skid 12 is made of a sole plate 13 resting on the ground and braces constituting shock-absorbing means 14, made up in this case of three blocks of polyethylene foam fixed between the sole plate 13 and the deck 11. The three blocks 14 have substantially the same width as the sole plate and have the same height as one another in order to keep the platform horizontal in its normal load bearing position. Two of the three foam blocks 14 of each skid shown are glued in the end portions of the sole plate, and the third block 14 is placed in the middle portion. In addition, the three foam blocks 14 of each skid 12 shown are inserted between the sole plate 13 and two respective upper boards 15. Each board 15 illustrated is supported entirely on one end foam block and partly on the middle foam block. The two boards 15 are also provided with adjustable means for fixation to the deck 11, for example by screwing. In the present case, the screwing is accomplished by nuts, and bolts or screws to be inserted into the boards 15 at the level of the foam blocks 14 in correspondence with holes drilled into the deck for the passage of screws 16. Hence the three foam blocks 14 readily absorb impacts with a vertical component.

The pallet is also provided with means for absorbing impacts with a horizontal component as well. The means illustrated are embodied by two bumper fittings 17 placed under the deck at the ends of the skids and projecting from the edges of the deck. FIG. 3 shows one exemplary embodiment of a fitting 17. A first flat portion 17*a* is placed against the outer lateral face of a foam block 14 on the end of the skid and is fixed to that block. The fitting 17 has a middle portion 17*b* perpendicular to the portion 17*a* and substantially covering the front face of the skid, and a third portion 17*c* that lengthens the first flat portion 17*a* and partly lengthens the middle portion 17*b*, terminating on the other side of the front or rear edge of the deck and thus furnishing better absorption of longitudinal impacts. Each fitting 17 is fixed to the sole plate and/or to the foam blocks 14, in particular by adhesive bonding or nailing. In the example shown, it is fixed to the foam block in such a way that the deformation of the fitting when lateral impact occurs can be reflected directly to the foam block 14 and is better able to absorb impacts. The fixation shown (represented by the axes in FIG. 3) is done with three wood screws 17*d*, two of which fix the first portion 17*a* of the fitting and the third of which fixes the middle portion 17*b*. Each fitting shown is also fixed to the deck by a jack 18 shown lower down.

The means for supporting the jack also include jacks 18 that make it possible to vary the height of the deck with respect to the ground, under the conditions to be described hereinafter. The jacks 18 shown are disposed at the four corners of the pallet and are each made of a large screw or bolt that rotates in nuts to be hammered into or affixed to the deck 11.

Figure 4:
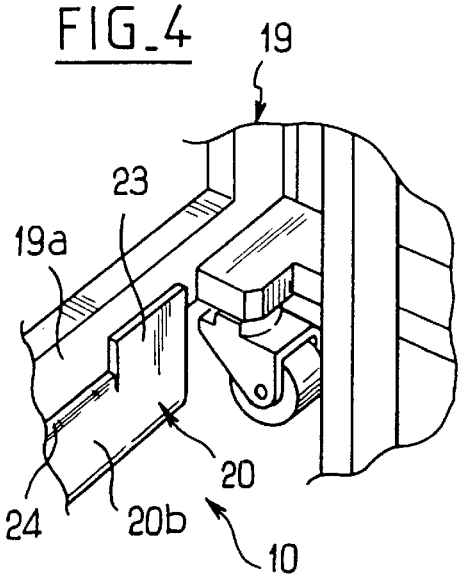
FIGS. 4 and 5 are perspective views of the lower portions of the cabinet shown in the respective circles in FIG. 1, to illustrate the details of the means for retaining the cabinet on the pallet.
Figure 5:
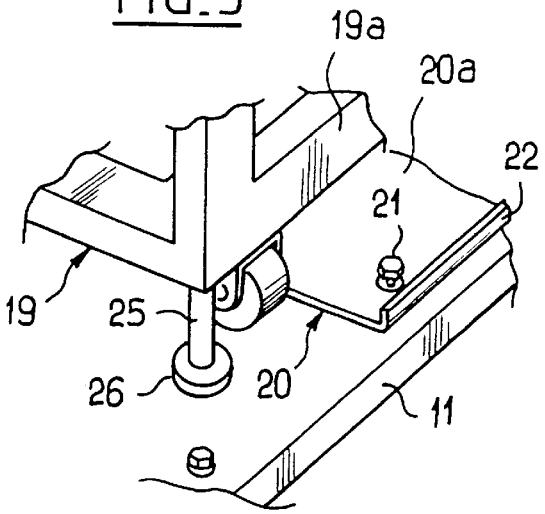
Figure 6:
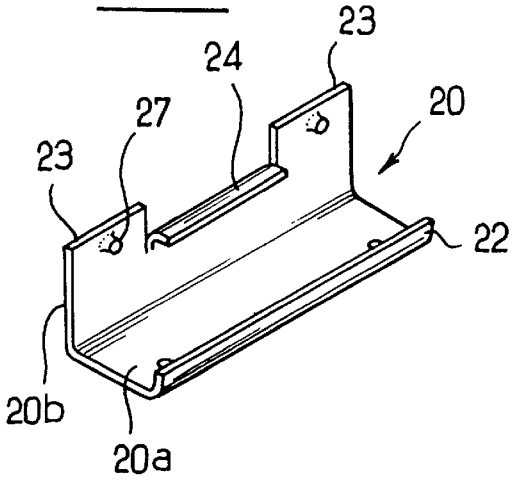
FIG. 6 is a perspective view of a retaining clip or strap for the cabinet.
Figure 7:
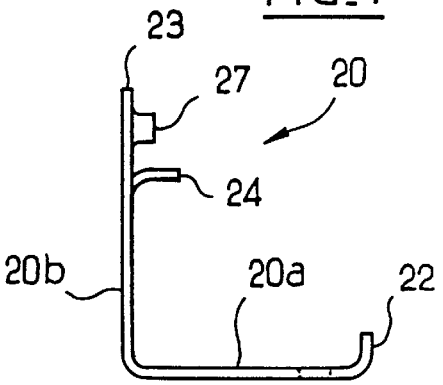
FIG. 7 is a side view of the strap shown in FIG. 6.

The deck 11 is provided with means for retaining a cabinet 19, schematically represented in FIG. 1 by its partially equipped frame (closed with two lateral panels, merely in such a way as to allow one to see its inside structure). FIGS. 4 and 5 show details of the cabinet retaining means. These means are embodied by two straps or clips 20 fixed movably to the deck 11. FIGS. 6 and 7 show one exemplary embodiment of a strap or clip 20. Each strap or clip 20 has the general form of two squared-off or right angle fins 20*a*, 20*b*. The fin 20*a* is fixed movably to the deck 11, for example by screws 21 rotating in nuts to be hammered or affixed to into the deck. The free end of fin 20*a* terminates in a maneuvering rim 22. The fin 20*b* is extended by two laterally spaced vertical tabs 23 and one intermediate tab 24 folded down parallel to fin 20*a* and extending inwardly toward rim 22 as shown in FIG. 6. With reference to FIGS. 4 and 5, the horizontal tube 19*a* constituting an element of the lower portion of the frame of the cabinet is intended to rest on the intermediate tab 24. In the example shown, the intermediate tabs 24 of the two straps can support the weight of the cabinet. In the example shown in FIGS. 4 and 5, the cabinet 19 has casters whose height is less than the height of the intermediate tabs 24 from the deck 11. However, as shown in FIG. 5, the cabinet also rests on the deck by way of jacks 25 placed solely in order to increase the seating area for the cabinet on the deck and to assure better stability of the cabinet in the case of impact. To reinforce this effect, the feet of the jacks 25 preferably rest within surface indentations 26 of the deck. The jacks 25 also have another role which will be described hereinafter. The lateral tabs 23 serve the purpose of fixation of the cabinet 19 against relative rotation and transverse translation, and they have two respective claws 27 or inward extensions or nibs that engage two corresponding holes made in the tube 19*a* in order to assure the fixation of the cabinet against relative rotation and longitudinal translation. Hence the straps or clips 20 shown have a triple role: They bear the entire weight of the cabinet; they fix the cabinet against relative rotation or translation; and in the case of lateral impact, they absorb the energy of the impact by forming at the level of the tabs 24 and their fins 20*b*. However, it is understood that it is possible in general for their role to be limited essentially to the fixation of the cabinet. In other words, the cabinet could be supported entirely or partially by its casters or other elements.

Figure 8:
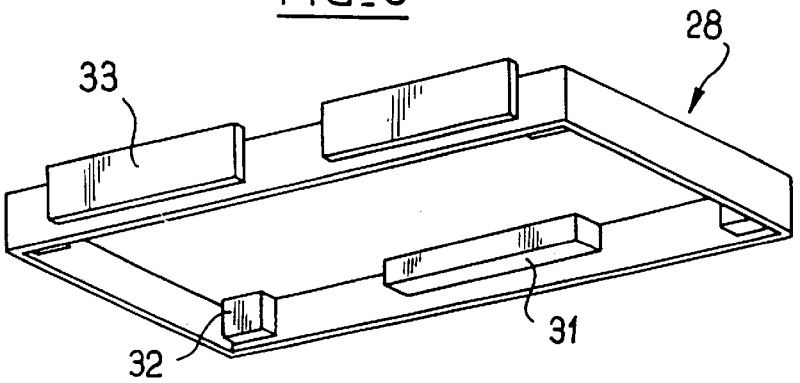
FIG. 8 is a perspective view from below of the hood carried by the cabinet.
Figure 9:
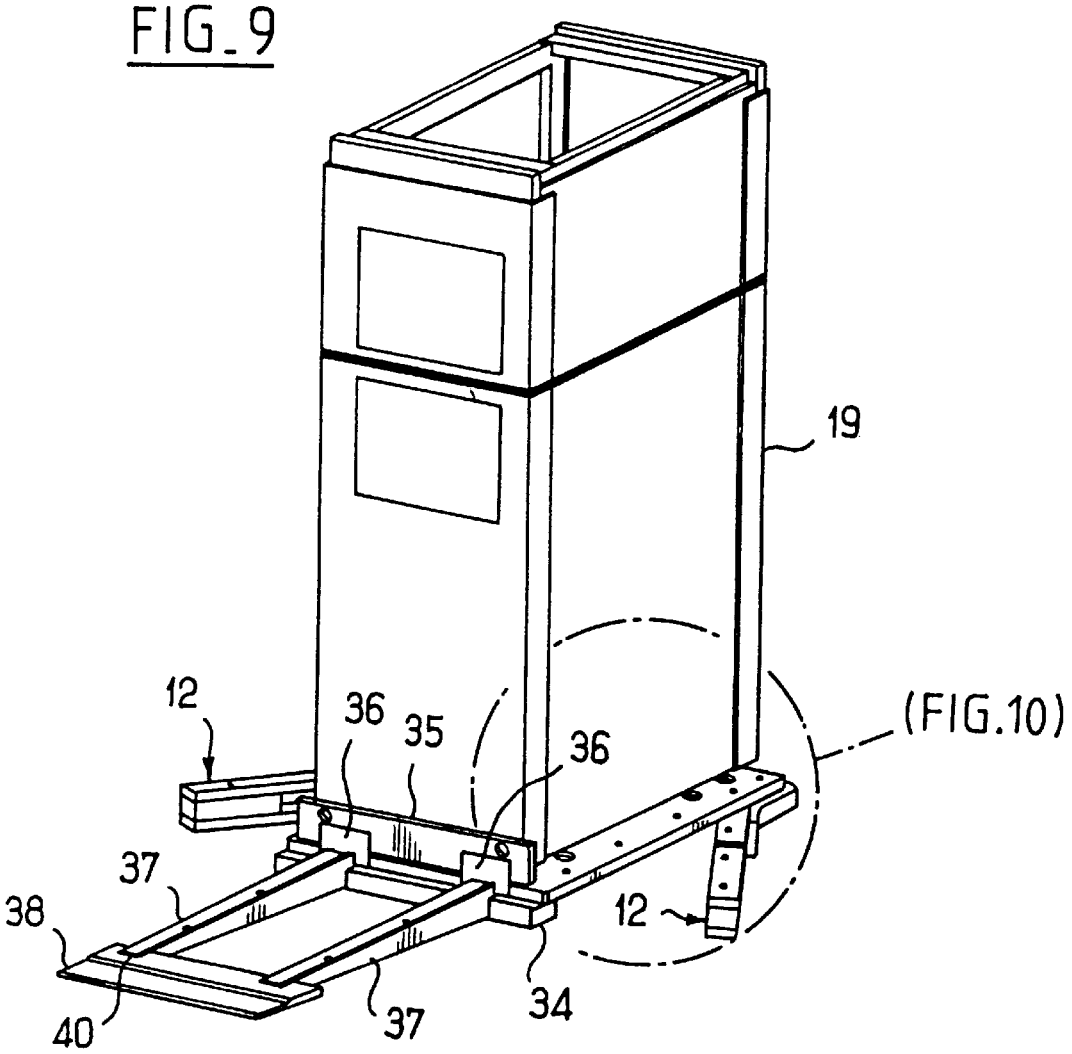
FIG. 9 is a perspective view of the pallet shown in FIG. 1, illustrating the method for depalletization according to the invention.

The means for retaining the cabinet also include a hood or shroud 28 fixed to the top (roof) of the cabinet and shown in perspective from below in FIG. 8. In the example shown in FIG. 1, the cap of the cabinet is removed in order to reveal the frame. Normally, the cap is placed neck to the cabinet, in a manner not shown in the drawings. The roof of the cabinet, in its four corners, carries large nuts 29, respectively, for screwing rings for raising the cabinet by means of a bridge or a crane. The nuts 29 serve to fix two parallel slats 30, which are preferably perpendicular to the skids 12, and extending past each edge of the cabinet by a given length. The slats 30 serve to support the hood 28. The hood is ordinarily made of cardboard or some similar material. It is folded down onto the edges of the cabinet by way of shock-absorbing blocks 31, which have a thickness corresponding substantially to the given length by which the slats 30 project. This length lends the blocks a sufficient thickness for good shock absorption. Foam blocks 32 are also provided at the four inner corners in such a way as to compensate for the possible lengths of various cabinets and so that one need have only a single hood for cabinets of various length. The hood 28 also includes outer lateral foam blocks 33 of slight thickness, which are provided to reinforce the shock absorption, especially in the case of transverse impact or shock. Also attached to the hood 28 is a number of accessories necessary for the depalletization, which are shown in FIGS. 9 and 10 relating to them. The hood shown contains the following: a shim 34, formed of a wooden board with a thickness of about 50 mm and a length at least greater than the spacing of the jacks 18; a stop slat 35 of the cabinet, substantially having the same length as the shim 34; two check plates 36; two ramps for putting the cabinet onto the ground; and two rulers 38 intended to terminate the two ramps in such a way as to form two steps for the final descent of the cabinet.

Depalletization of the cabinet 19 is done as follows. Let it be assumed that the preliminary step of packaging is completed. Briefly, this step consists of freeing the cabinet from its wrapper (not shown), which is ordinarily of shrink-wrapped plastic, and from its hood 28 and the two straps or clips 20. In order to remove the two straps or clips, the jacks 25 of the cabinet are maneuvered in order to raise the cabinet slightly and to relieve the tabs 24 of the straps 20 of the weight of the cabinet. The straps 20 can then be removed by unscrewing screws 21 that fix the fin 20*a* to the deck 11 and by pivoting the straps, by means of the maneuvering rims 22, in such a way as to release the claws 27 from the frame of the cabinet. The step of depalletization begins with the choice of the edge of the deck by which the cabinet will be lowered. The front edge of the deck in terms of FIGS. 2, 9 and 10 will be chosen, with the opposite edge being called the rear edge.

The depalletization step is described with reference to FIGS. 9 and 10. On the front edge of the deck, the three screws 17*d* (FIG. 3) and the two jacks 18 are unscrewed until the two fittings 17 on the front of the skids 12 can be released from the deck and removed. In addition, the two front screws 16 are unscrewed completely, while the other two screws 16 on the rear edge of the deck are simply loosened. The order in which these operations are done matters little. Next, the shim 34 is placed under the deck in such a way as to serve to support two front jacks 18. Optionally, the support surface may be reinforced by adding steel washers (not shown) to the shim. These two jacks are then lowered in order to rest on the shim 34 and slightly raise the front edge of the deck, in such a way as to be able to free the two skids 12 and cause them to pivot toward the outside of the deck about their respective rear screws 16. In practice, pivoting by approximately 30° is sufficient. It should be noted that in this position, the weight of the cabinet rests entirely on the deck 11 and is distributed over the shim and the two skids that have been moved out of the way. The deck accordingly has a very strong structure, formed for example by a thick wooden panel, which is on the order of 30 mm thick in the example made. Next, the front jacks 18 are maneuvered until the front edge of the deck comes to rest on the shim 34. These jacks can be removed. The two ramps or rails 37 are placed against the front edge of the deck, and are preferably positioned at predetermined locations, by introducing the upper ends of the ramps into two respective recesses 39 made there in the front face of the shim 34. The upper ends of the two ramps or rails 37 are provided with means for fixing the two check plates 36 there. The means illustrated comprise a raised portion of the side edges of the ramps. Next, the stop slat 35 is placed between the two check plates 36 and the cabinet. The two rulers or steps 38 are placed transversely to the ramps on the other end of the ramps or rails 37. The first ruler or step 38 is adjacent to the ends of the rails and has a thickness that corresponds substantially to the height of the end of the adjacent rail. Preferably, this ruler is provided with recesses 40, similar to the recesses 39 in the shim 34, for the positioning of the ends of the rails and thus assuring the parallelism of the rails. The second ruler or step 38 has a lesser thickness. This arrangement now makes it possible to remove the cabinet for the pallet. It suffices then to lower the cabinet by means of the jacks 25, in order to place its casters on the deck, to position it correctly with respect to the ramps 37, remove the check plates 36 and the stop slat 35, and to roll the cabinet on the ramp 37 and the wedge step 38 in order to place the cabinet on the ground.

This depalletization method offers numerous advantages. First, moving the skids 12 out of the way is easy and greatly increases both the seating area and the stability of the pallet. Second, the shim 34 is simple and further improves the stability of the pallet. In addition, the foam blocks 14 of the skids 24 limit the pressure of the jacks 18 on the shim 34. In another advantage, the rear of the deck rests on the skids, which are 100 mm in height, while the front rests on the shim 34, which is 50 mm in height, and the length of the deck is on the order of 1.10 m. The result is an inclination of about 3.5° which is favorable for shifting the cabinet outside the pallet. However, the thrust force of a 500 kg cabinet with an angle of inclination of 3.5° is on the order of only 30 kg. Thus in order to retain the cabinet in place when it rests with its casters on the deck, the stop slat 35 and the two check plates 36 may be simple, inexpensive elements. Conversely, this force of slight intensity considerably aids the operator in shifting the cabinet to outside the pallet. As another advantage, the upper ends of the ramps have merely a reduced height, in this case 80 mm (50 mm for the shim+30 mm of the thickness of the deck) compared with that of conventional pallets, which would have been 130 mm (100 mm for the skid+30 mm for the deck thickness). Thus the ramps can be simplified and can each be constituted of a metal rail 2 mm thick and can have a slight length that allows them to be accommodated within the hood 28. The two rulers or steps 38 offer the advantage of further reducing the length of the ramps and of facilitating the descent of the cabinet to the ground. In the example shown, they act in fact as steps to lessen the slope of the rails and to prevent the ends 26 of the jacks 25 from meeting the ground. All the accessories comprised by the shim 34, the stop slat 35, the check plates 36, the ramps or rails 37, and the rulers or step 38 are accordingly not very expensive, are easy to use, are not very heavy relative to the weight of the load, and can easily be accommodated in the hood. In addition, the two slats 30 shown in FIG. 1 can play the role of the stop slat 35 and one of the rulers or steps 38, respectively. The result of this pallet is a simple, inexpensive, very fast depalletization method that assures great stability for any load and that can be performed easily by a single person.

The description above will suggest numerous variants to one skilled in the art. For example, the rulers or steps 38 would not be necessary if the cabinet has no jacks or if the jacks can be raised higher. Similarly, the check plates 36 are not necessary in the example shown, if two persons are used for the depalletization, one of them holding the cabinet. The order in which the stop slat 35 and the check plates 36 are placed does not matter. Moreover, the shim 34 can be fixed under the deck, for example, and the jacks would then serve merely to lower the front edge of the deck until it rests on the shim. With this limitation, the jacks may suffice and the shim would then be unnecessary. The shim could also be replaced with feet, placed under the deck, that lengthen the lower portion of the upper ends of the ramps. It will also be appreciated that the front edge of the deck could rest directly on the ground, if the inclination of the deck is not prejudicial to the depalletization and to the safety and security of the cabinet and persons involved. In that case, the two rear jacks 18 could also be used in such a way as to raise the rear edge of the deck and allow the operator to remove the skids by unscrewing the screws 16 and then lower the rear edge to a height where the inclination will be more appropriate. For the depalletization of very heavy loads, on the order of 500 kg and more, the most appropriate angle of inclination is about 4°, for the reasons apparent from the foregoing description. The rear edge could also rest on a shim such as 34. In that case, it would no longer be necessary to use ramps 37. The thickness of the deck, which depends on the weight of the load and which may be relatively great (on the order of 30 mm in the example shown), may be acceptable for lowering the cabinet if the impact resulting from this lowering of its level is within prescribed tolerance margins. Otherwise, the edges of the deck may be made thinner by giving them a beveled form, or guide ramps may be provided, which would have the advantage of simply being small wedges of wood capable of resting entirely on the ground.

Moreover, it will be understood that the two rear jacks 18 are not used for the depalletization method shown and hence may be omitted. However, their presence highly advantageously allows the operator to choose the side from which the cabinet is taken from the deck. Their presence could also allow the addition of intermediate skids, since these jacks can be used with the two front jacks in order to remote the intermediate skids in the same way as the two lateral skids are removed. Moreover, the pivot shafts of the skids may be placed closer to the front side of the deck and can be placed in the middle of the deck. In that case, the depalletization could be done from either the front or the rear edge. It would suffice for the ends of the skids to be fixed removably to the deck, while in the example shown only the front ends of the skids are fixed removably to the deck, by the front screws 16.

In general, the subject of the invention is accordingly a pallet 10 for transporting a load 19 that includes a deck 11 and means for supporting the deck that include two skids 12 and make it possible to incline the deck to depalletize the load.

In the example shown, the two skids 12 are mounted in such a way as to be capable of pivoting into the plane of the deck about respective shafts 16 near one edge of the deck, and the means for supporting the deck include jacks 18 that allow varying the height of the opposite edge of the deck relative to the ground. However, it has been seen that the shafts may be placed in the middle of the deck, although the general principle of the pallet shown comprises mounting the two skids 12 in such a way that they can pivot into the plane of the skid, and the means for supporting the deck include jacks that make it possible to vary the height of one edge of the deck.

In other variant, one could also contemplate the case where it would suffice to remove one skid by means of the front jack 18 and the rear jack 18 relative to that skid, and to lower the corresponding edge of the deck. Then, the shim 34 could be placed under that edge.

Preferably, each skid includes a sole plate, which rests on the ground, and shock-absorbing means, such as at least one foam block 14, serving as a brace between the deck and the sole plate of the skid. The skid may have only a single brace disposed on a major portion of the sole plate, or as illustrated may have a plurality of foam braces in the form of blocks, which may be separated to constitute another way of access for the forks of transport vehicles. Other materials or structures can serve as shock-absorbing means. It has also been seen in the example shown that the foam blocks are fixed between the sole plate 13 of the skid and two boards 15 provided with removable means 16 for fixation to the deck of the pallet, by screwing, for example. This option has the advantage of being simple and inexpensive. The fact that two boards are used, instead of one, which would also be possible, facilitates the deformation of the foam blocks. As another advantageous option, the shock-absorbing means include two anti-impact fittings 17, which can be fixed to the foam blocks and/or to the skid sole plate and/or to the deck and serve to absorb impacts with a horizontal component. Preferably, these fittings project from the deck so as to better absorb all the horizontal components of the impacts. These fittings are made of foam in the example shown, but they may also be made of wood and may be constituted by a single salt extending along each skid. In addition, the displacement of the load may be done by rolling, as illustrated, or by sliding. In the case where the load is fixed to the pallet by means of straps 20, it has been seen that these straps are removed before the deck is inclined. However, depending on the retention means used, the inclination of the deck may be independent of the unstrapping or the removal of these means.

The depalletization method is also apparent from the foregoing description. In general, the method for depalletizing a load 19 mounted on a pallet 10 made of a deck 11 resting on skids 12 consists of inclining the deck.

It has been seen that the principle of the example shown consists of causing the skids to pivot parallel to the deck, and then lowering one edge of the deck and shifting the load to this edge. Nevertheless, it has also been seen that it may comprise raising one skid and lowering the corresponding edge of the deck, or again of removing the skids and lowering two opposite edges of the deck to unequal heights.

To increase the stability, a shim is preferably placed under one edge of the deck. This deck may be the front (lowered) edge as in the example shown, or the rear edge, or even a lateral edge. In order to keep the load on the deck despite its inclination, stop means may be employed.

While the preferred forms and embodiments of the invention have been illustrated and described, it will be apparent to those of ordinary skill in the art that various changes and modifications may be without deviating from the inventive concepts and spirit of the invention as set forth above, and it is intended by the appended claims to define all such concepts which come within the full scope and true spirit of the invention.

We claim:

1. A method for depalletizing a load (19) mounted on a pallet (10) having a deck (11) resting on skids (12), said skids each having a pivoted end and a pivoting end, comprising inclining the deck and displacing the load along said inclined deck;

wherein said step of inclining the deck includes pivoting the skids parallel to the deck to move the pivoted ends of the skids outside a perimeter of said deck, such that said deck rests on said skids only at said pivoting ends of said skids, and lowering a portion of said deck not supported by said pivoted skids in order to incline the deck and displace the load along said inclination.

2. The method of claim 1, including placing a pivot shaft (16) in proximity with one edge of the deck about which said skids may pivot and pivoting the skids toward an outside perimeter of the deck.

3. A pallet (10) for transporting a load (19), comprising a deck (11) and at least a pair of skids (12) supporting the deck, said skids being mounted for pivoting movement into and out of a plane of the deck, and a plurality of jacks (18) coupled to said deck and extending downwardly from said deck, each of said plurality of jacks having means for varying a height of one edge of the deck relative to the ground.

4. The pallet of claim 3, including a plurality of shafts (16) disposed adjacent one edge of the deck, each of said skids being mounted for pivotal movement about an associated one of said shafts.

5. The pallet of claim 3 including a plurality of shafts (16) disposed in a center portion of the deck and each of said pair of skids being mounted to pivot about an associated one of said shafts.

6. The pallet of claim 3 including a shim (34) adapted to be placed under a lowered edge of the deck for depalletizing the load.

7. The pallet of claim 3 including a ramp (37, 38) providing an inclined surface for depalletizing the load.

8. The pallet of claim 3 including an inclined surface on the deck and stop means (36) for maintaining the load on the deck surface when said deck surface is inclined.

9. A pallet (10) for transporting a load (19), comprising:

a deck (11) for mounting the load thereon;

at least a first skid and a second skid attached to a lower surface of the deck, said first skid being attached to a first side of said deck and said second skid being attached to a second side of said deck opposite said first side, for supporting said deck, each of said first and second skids being mounted for pivotal movement about an associated shaft extending perpendicularly to said lower surface; and fixing means for selectively fixing said first and second skids to said lower surface of the deck, said first and second skids being selectively positionable by disengaging each of said skids from said fixing means and displacing one free end of each skid outside of a perimeter of the deck, whereby said deck is not supported by said free ends of said skids thereby allowing said deck to be inclined when depalletizing the load.

10. A pallet according to claim 9, further comprising at least two jacks (18) coupled to said pallet and having means for varying the height of one edge of the deck relative to the ground.

11. A pallet according to claim 10, wherein said shafts are disposed adjacent one edge of the deck.

12. A pallet according to claim 10, wherein said shafts are disposed in a central portion of the deck.

13. A pallet according to claim 9, further comprising a shim (34) adapted to be placed under, and adapted to support, a lowered edge of the deck.

14. A pallet according to claim 9, including a ramp (37, 38) providing an inclined surface for depalletizing the load.

15. A pallet according to claim 9, including an inclined surface on the deck and stop means (36) for maintaining the load on the deck surface when said deck surface is inclined.

16. A method for depalletizing a load (19) mounted on a pallet (10), said pallet comprising:

a deck (11) for supporting the load thereon;

at least a pair of skids (12) attached to a lower surface of the deck at opposing sides thereof for supporting said deck, said skids being mounted for pivotal movement about a shaft (16) perpendicular to said lower surface; and fixing means (16) for selectively fixing said pair of skids to said lower surface of the deck;

and wherein said method comprises the steps of:

disengaging each of said skids from the fixing means;

displacing one free end side of each of said disengaged skids to a position outside a perimeter of the deck whereby said free end side of said skids does not support said deck from underneath;

inclining a portion of said deck which is not supported by said skids when said free ends of said skids are so displaced; and moving said load along an upper surface of said inclined deck.

* * * * *